US012590781B1

(12) United States Patent
Brown

(10) Patent No.: US 12,590,781 B1
(45) Date of Patent: Mar. 31, 2026

(54) PRELOADED DISPOSABLE CYLINDER SYSTEM FOR REVOLVER

(71) Applicant: Luther E. Brown, Ooltewah, TN (US)

(72) Inventor: Luther E. Brown, Ooltewah, TN (US)

( * ) Notice: Subject to any disclaimer, the term of this patent is extended or adjusted under 35 U.S.C. 154(b) by 0 days.

(21) Appl. No.: 19/361,894

(22) Filed: Oct. 17, 2025

(51) Int. Cl.
*F41C 3/14* (2006.01)

(52) U.S. Cl.
CPC ..... *F41C 3/14* (2013.01)

(58) Field of Classification Search
CPC ..... F41A 9/85; F41C 3/14
USPC ..... 42/59–61
See application file for complete search history.

(56) References Cited

U.S. PATENT DOCUMENTS 522,472 A * 7/1894 Lamm ..... F41A 15/02 42/63
959,229 A * 5/1910 Kolb ..... F41A 9/28 42/59
2,830,398 A * 4/1958 Donohue ..... F41C 9/085 42/59
3,765,116 A * 10/1973 Zaid ..... F41A 9/85 42/59
4,558,530 A * 12/1985 de Witt ..... F41C 3/14 42/59
6,928,763 B2 * 8/2005 Zajk ..... F41C 3/14 42/59
7,194,834 B2 * 3/2007 Falenwolfe ..... F41A 9/38 42/65
2016/0282081 A1 * 9/2016 Lawing ..... F41A 9/85

FOREIGN PATENT DOCUMENTS

FR 2398280 A1 * 2/1974 ..... F41C 3/14

* cited by examiner

*Primary Examiner* — Reginald S Tillman, Jr.
(74) *Attorney, Agent, or Firm* — Chambliss, Bahner & Stophel, P.C.; Stephen D. Adams

(57) ABSTRACT

A preloaded disposable cylinder system for revolvers comprising a disposable cylindrical body, which is preferably 3D printed with chambers preloaded with propellant, primer, and projectile components without cartridge cases. The system includes boss pads and tapered cylinder end guideways for precise alignment, a spring-loaded center pin mechanism for secure retention, and eliminates traditional crane mechanisms and extractors. The design provides faster reload times than conventional revolvers, stronger dual-end cylinder lock-up, enhanced accuracy through improved alignment, and reduced manufacturing complexity. Compatible with existing revolver designs through minor frame modifications.

18 Claims, 13 Drawing Sheets

PRELOADED DISPOSABLE CYLINDER SYSTEM FOR REVOLVER

FIELD OF THE INVENTION

The present invention relates to firearms, and more particularly to revolver designs incorporating preloaded disposable cylinders that eliminate the need for traditional cartridge cases and associated extraction mechanisms.

DESCRIPTION OF RELATED ART

Traditional revolvers have remained fundamentally unchanged for over 125 years, continuing to rely on cartridge-based ammunition systems that require complex extraction and reloading procedures. Conventional revolvers require multiple steps to reload, including opening the cylinder via a crane mechanism, ejecting spent cartridges using an extractor system, inserting new cartridges, and closing the crane mechanism. Even with the advent of speed loaders, conventional revolvers still require seven distinct steps for reloading compared to three steps for semi-automatic pistols.

The traditional revolver design includes several inherent limitations that affect both performance and manufacturing efficiency. The crane mechanism required to support the cylinder creates structural weaknesses in the frame through necessary cutouts, compromising overall frame integrity. The ratchet and pawl system used for cylinder rotation requires extremely precise manufacturing tolerances and is subject to mechanical wear over time. Additionally, the extraction system adds complexity and potential failure points while the cartridge-based ammunition system introduces variables in headspace control and combustion chamber dimensions.

Recent advances in 3D printing technology and improvements in materials compatible with 3D printing now make possible new approaches to revolver design that can address these longstanding limitations. However, no existing revolver design has successfully eliminated the fundamental cartridge-based ammunition system or the associated extraction and crane mechanisms while maintaining reliability and performance standards.

SUMMARY OF THE INVENTION

It is an object of the present invention to provide a revolver design that eliminates the need for traditional cartridge cases and associated extraction mechanisms.

It is another object of the present invention to provide faster reloading processes compared to currently available revolver designs.

It is a further object of the present invention to provide a stronger cylinder lock-up design compared to currently available revolver designs, with both ends of the cylinder secured directly into the frame structure.

It is yet another object of the present invention to provide improved cylinder alignment and positioning relative to the barrel bore, thereby enhancing accuracy potential.

It is an additional object of the present invention to significantly reduce manufacturing complexity and production costs by simplifying frame design and reducing the number of required components.

It is another object of the present invention to provide a revolver design that eliminates or simplifies problematic parts to manufacture including crane mechanisms, cylinder ratchets, extractors, hands, and cylinder stops.

It is a further object of the present invention to provide compatibility with existing Colt® and Smith & Wesson® revolver designs through minor modifications.

These and other objects are achieved by a preloaded disposable cylinder system for revolvers. As used herein, the term "revolver system" (e.g., revolver system 200) refers to the combination of a revolver frame (e.g., frame 204) specifically configured to directly receive a disposable cylinder, and the disposable cylinder itself (e.g., cylinder 202). The system comprises a disposable cylinder manufactured using 3D printing technology, the cylinder having chambers preloaded with propellant, primer, and projectile components without requiring separate cartridge cases. The system includes a revolver frame with a frame window configured to receive the disposable cylinder directly without requiring a crane mechanism, cylinder end guideways that provide precise positioning and support, and a spring-loaded center pin mechanism that secures the cylinder in position while allowing rotation.

In preferred embodiments, the cylinder rotation is controlled by a spring-biased pin system that engages a scribed line formed in the outer periphery of the cylinder, replacing traditional ratchet and pawl mechanisms. The system preferably provides a two-step reloading process comprising: (1) snap out the spent cylinder and (2) snap in a fresh cylinder, representing a faster reloading time compared to other conventional designs.

Preferably, the disposable cylinder is configured for single-use operation, eliminating concerns about metal fatigue, timing wear, and dimensional variations that affect conventional cylinders. The 3D printing process allows for precise control of chamber dimensions and combustion characteristics while enabling the use of lighter, less expensive materials suitable for single-use applications.

BRIEF DESCRIPTION OF THE DRAWINGS

A more complete understanding of the preloaded disposable cylinder system for revolvers will be afforded to those skilled in the art, as well as a realization of additional advantages and objects thereof, by consideration of the following detailed description of preferred embodiments. Reference will be made to the appended sheets of drawings which will first be described briefly. The drawings provided herein are not necessarily to scale and are included to illustrate the principles of the invention rather than to limit the invention to any particular configuration.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

As used herein, the term "cylinder lockup" means the precise alignment and secure locking of the cylinder to the frame of a revolver, thereby ensuring the chambers are perfectly aligned with the barrel for safe and accurate firing.

As used herein, the term "engagement component" means a mechanical feature formed on an exposed end of a threaded component that permits a tool to engage the component for rotation during assembly or disassembly operations, including but not limited to slots, hex sockets, Phillips heads, or other tool-engaging geometries.

DETAILED DESCRIPTION OF THE INVENTION

Conventional Revolver

Figure 1:
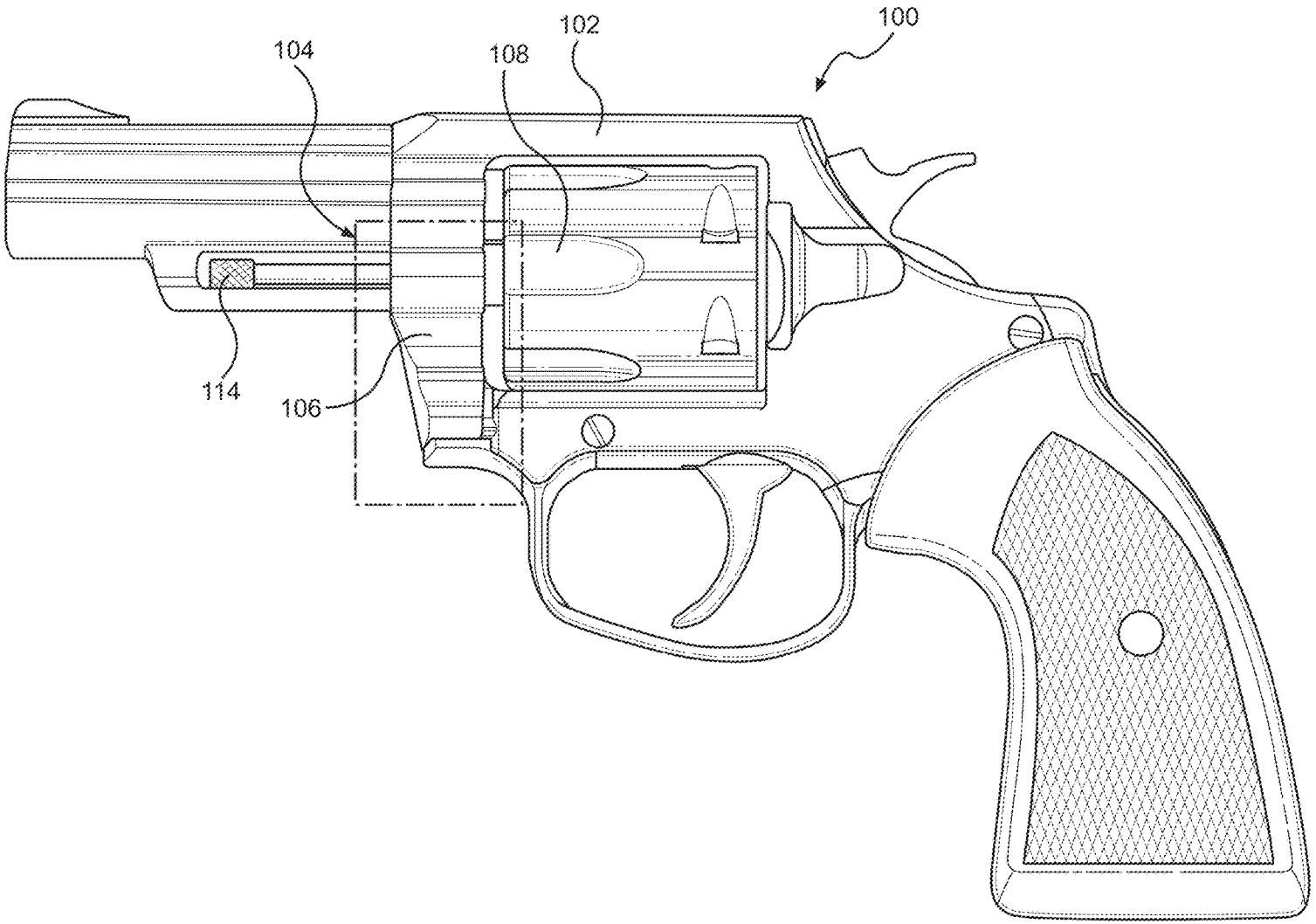
FIG. 1 (PRIOR ART)
FIG. 1 is a left side view of a conventional revolver in a closed position showing structural cutouts required for a crane mechanism.

Referring to the drawings, and with particular reference to FIG. 1, conventional revolvers, such as revolver 100, demonstrate several fundamental limitations including complex extractor systems for removing spent cartridge cases, structural weaknesses from crane cutouts, and slow multi-step reloading processes. Conventional revolver 100 represents the current state of the art and demonstrates the limitations that the present invention seeks to address. As shown in FIG. 1, the conventional revolver 100 includes a frame 102 with a cutaway portion 104 that accommodates a crane mechanism 106 for supporting a cylinder 108. Unfortunately, the cutaway portion 104 weakens the frame structural integrity and provides a potential failure point under high-stress firing conditions.

Figure 2:
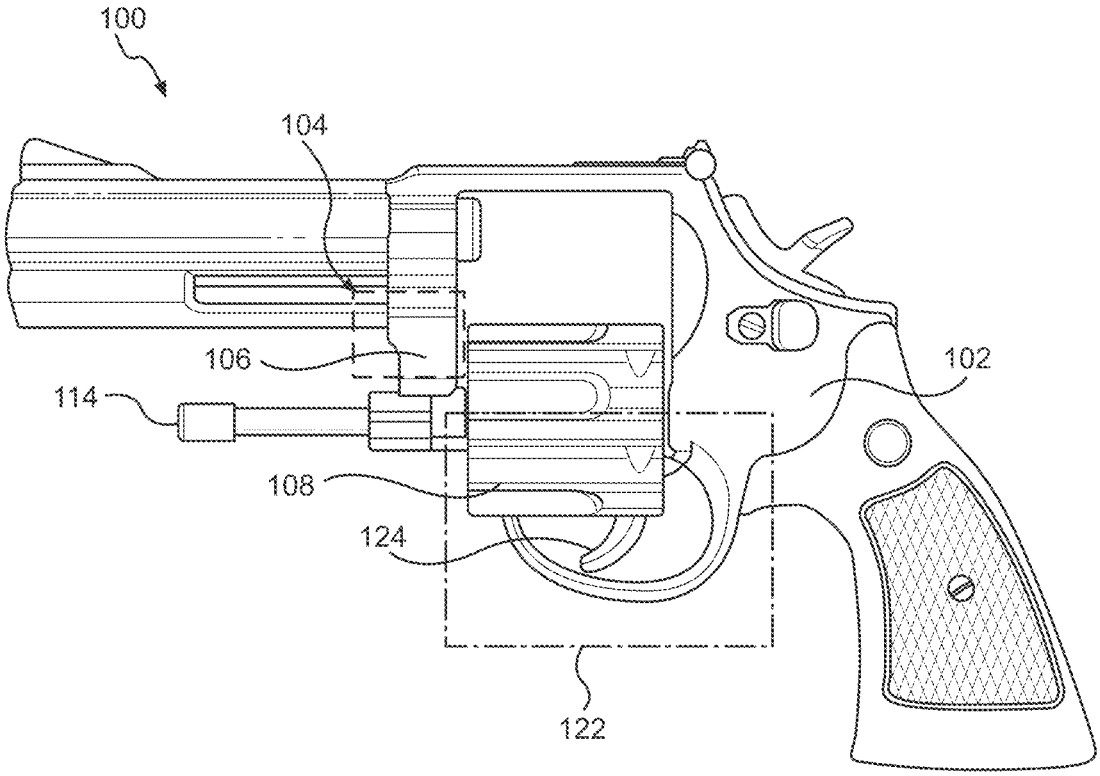
FIG. 2 (PRIOR ART)
FIG. 2 depicts the conventional revolver of FIG. 1 in an open position showing the crane mechanism supporting a cylinder.
Figure 3:
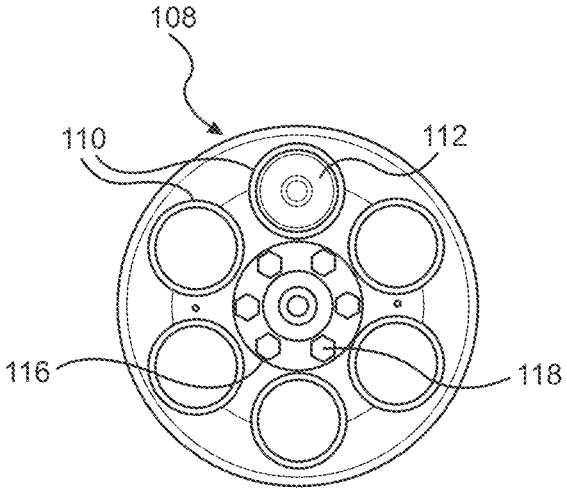
FIG. 3 (PRIOR ART)
FIG. 3 is a butt end view of the conventional cylinder of FIG. 1 showing chambers configured to receive traditional cartridges.

FIG. 2 shows the conventional revolver 100 in an open position, illustrating the crane mechanism 106 that hingedly mounts the cylinder 108 into the cutaway portion 104 of the frame 102. The crane mechanism 106 introduces additional mechanical complexity and represents a potential source of timing problems and mechanical failure. FIG. 3 provides a butt end view of the conventional cylinder 108 showing chambers 110 configured to receive traditional cartridges 112.

Figure 4:
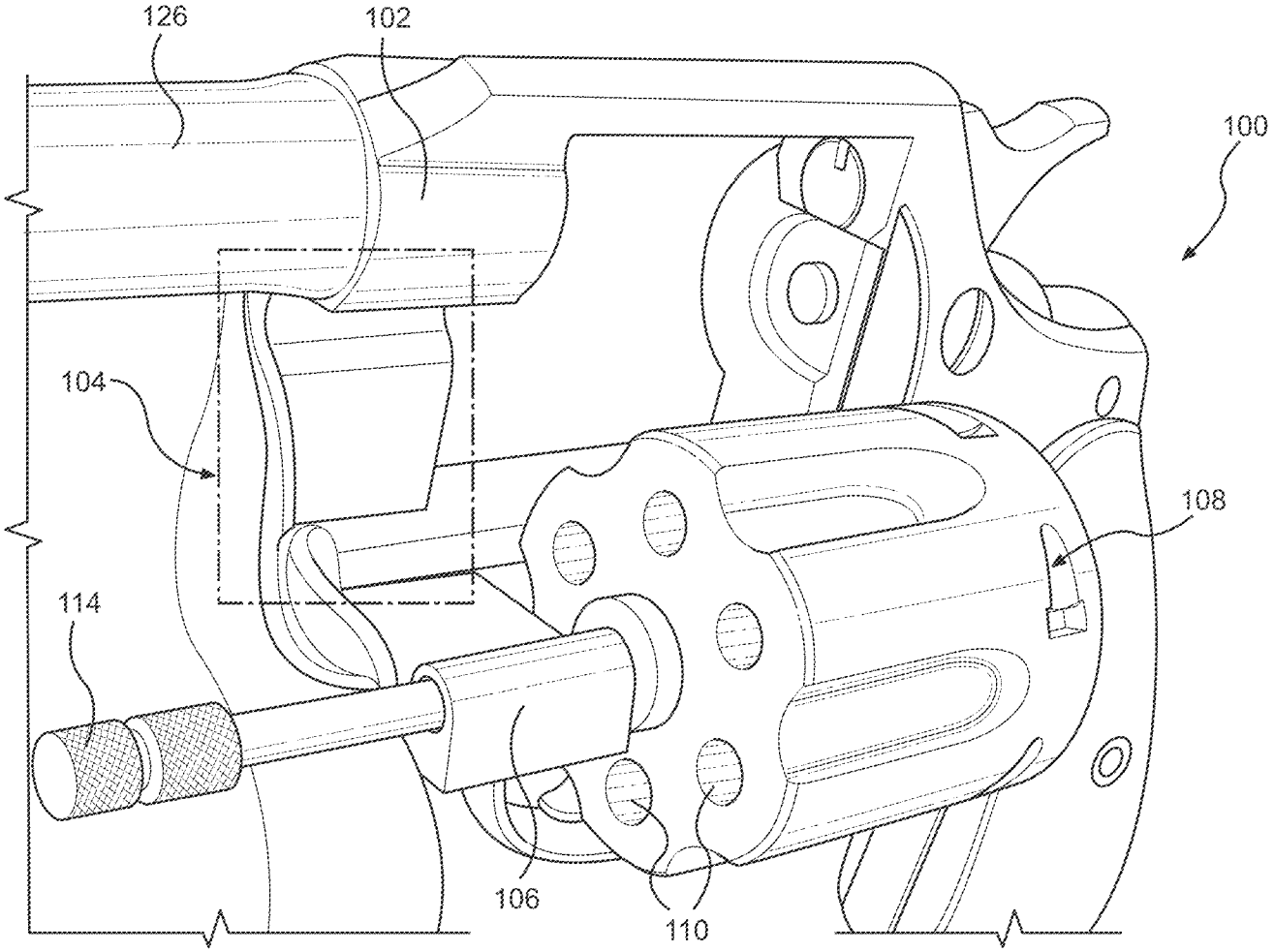
FIG. 4 (PRIOR ART)
FIG. 4 is a front left perspective view of the conventional revolver of FIG. 1 in an open position showing the crane mechanism supporting the cylinder.
Figure 5:
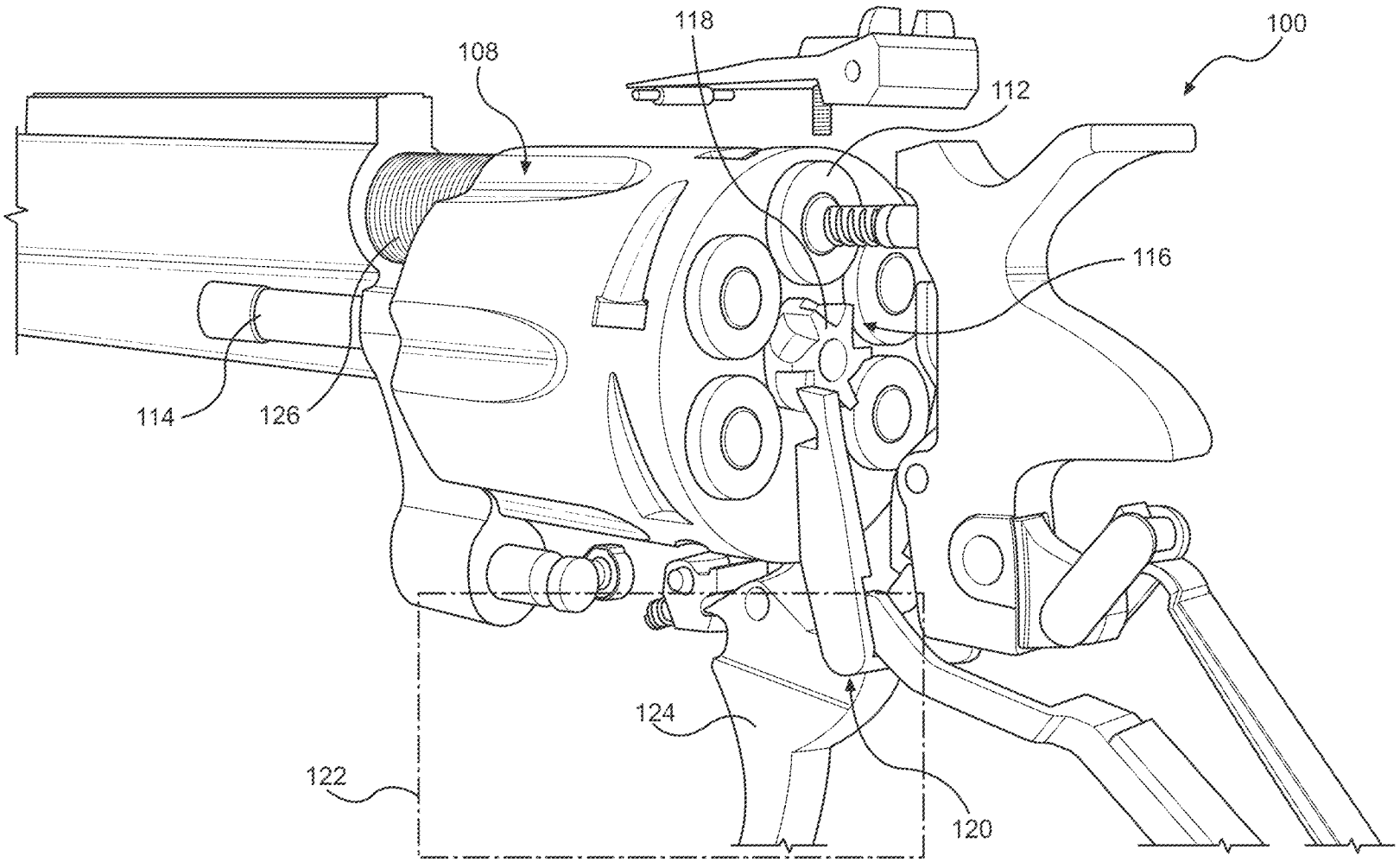
FIG. 5 (PRIOR ART)
FIG. 5 is a rear left perspective view of the conventional revolver of FIG. 1 showing internal components including a ratchet and pawl mechanism used in rotating the cylinder.

FIG. 4 and FIG. 5 provide perspective views of certain internal components of conventional revolver 100, including the cylinder 108 with chambers 110, traditional cartridges 112, extractor 114 for removing spent cartridge cases, ratchet 116 with teeth 118, pawl 120, trigger assembly 122 with trigger 124, and barrel bore 126. The traditional ratchet 116 and pawl 120 system requires extremely precise manufacturing tolerances and is subject to mechanical wear over time, affecting revolver performance and reliability. The extractor 114 adds additional mechanical complexity to the reloading process, requiring precise timing and creating another potential failure point that can bind or malfunction during extraction of spent cartridge cases.

Enhanced Revolver

Now, the preloaded disposable cylinder system of the present invention provides a revolutionary approach to revolver design that addresses the above-described limitations while providing faster reloading capabilities compared to currently-available designs.

Figure 6:
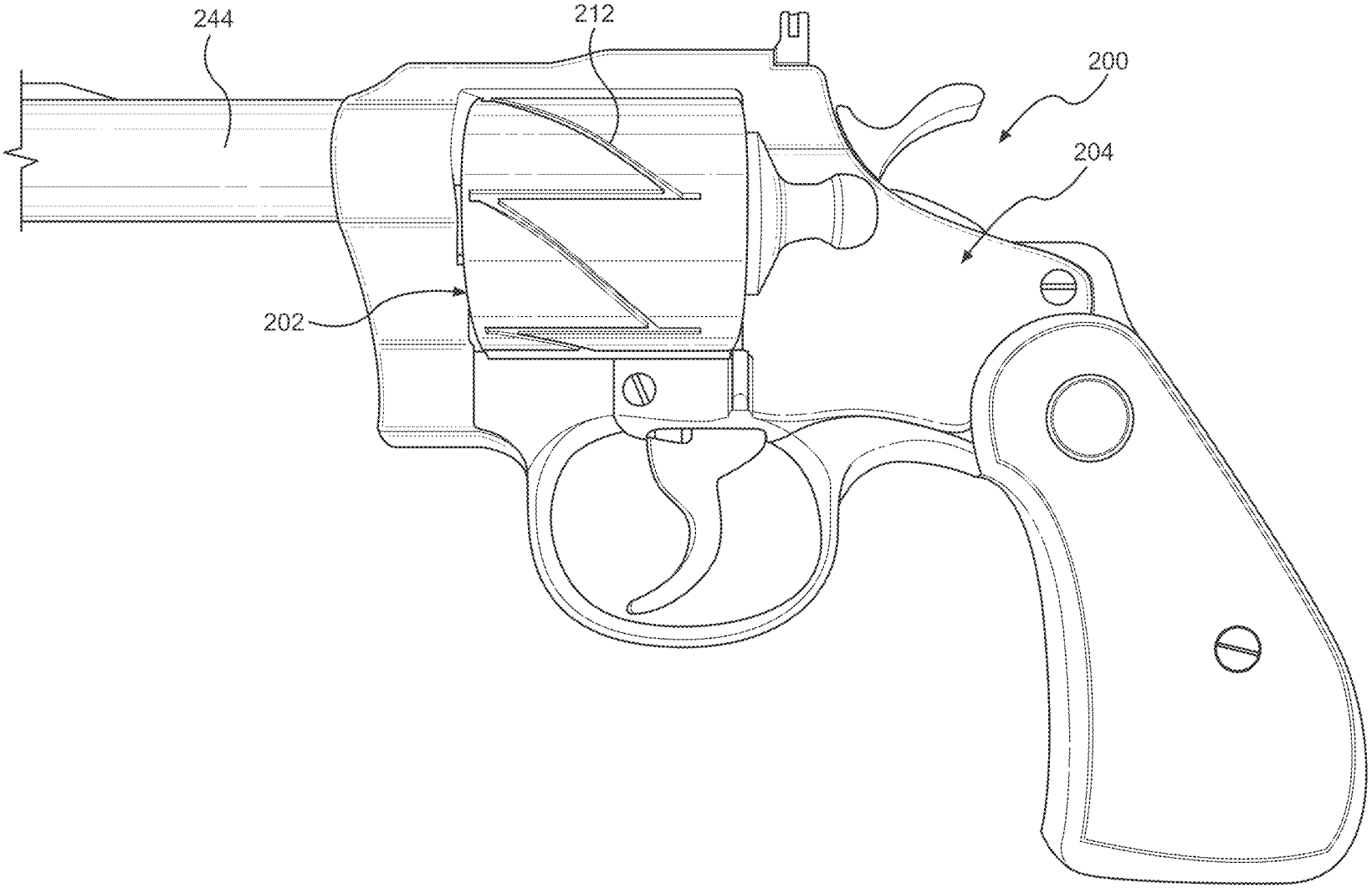
FIG. 6 is a left side elevation view of a revolver including a cylinder system and revolver frame according to an embodiment of the present invention.

FIG. 6 illustrates a revolver system 200 according to the present invention with an enhanced cylinder rotation mechanism and preloaded disposable cylinder system 202. The revolver system 200 includes a frame 204 that preferably lacks entirely cutouts for a traditional crane mechanism, providing superior frame strength compared to the conventional revolvers. The present design eliminates the structural weaknesses associated with conventional crane cutouts and provides superior frame strength and cylinder lock-up. The elimination of the crane mechanism and associated cutouts significantly reduces production costs by simplifying the design of the frame and reducing the number of parts.

Figure 7:
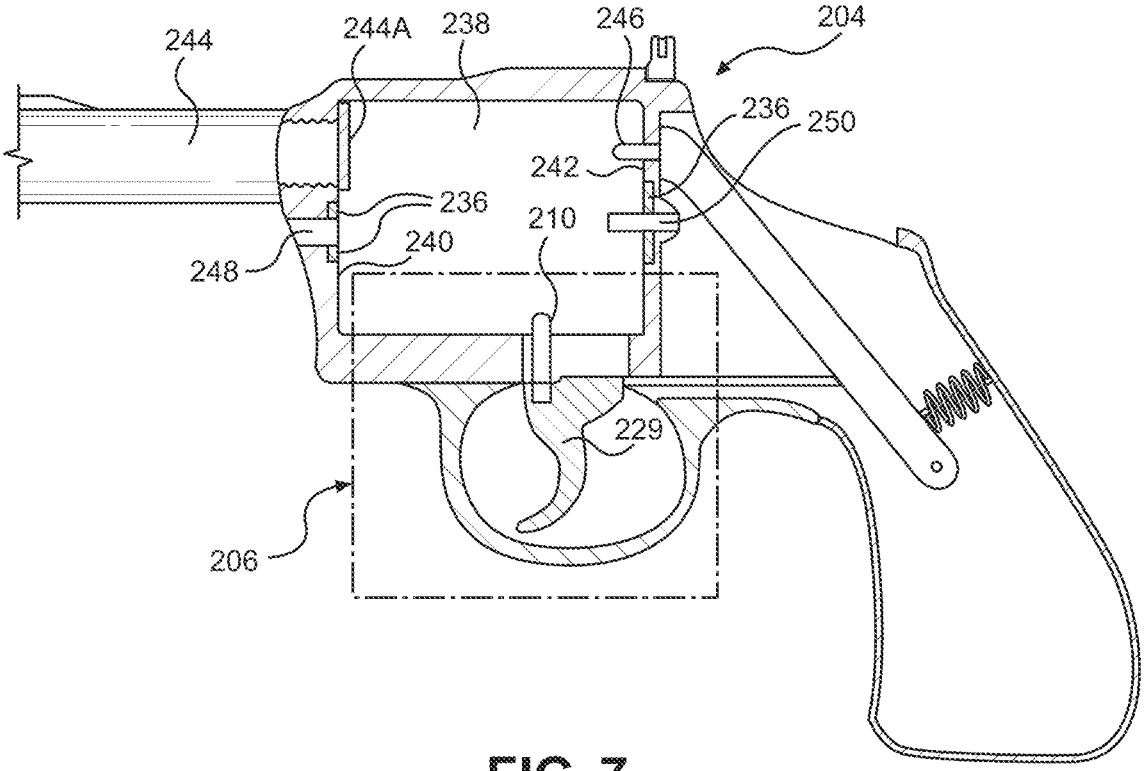
FIG. 7 depicts the frame of FIG. 6 without the cylinder system in place and with a trigger thereof in a forward position and showing a barrel extension protruding into a frame window thereof.
Figure 8:
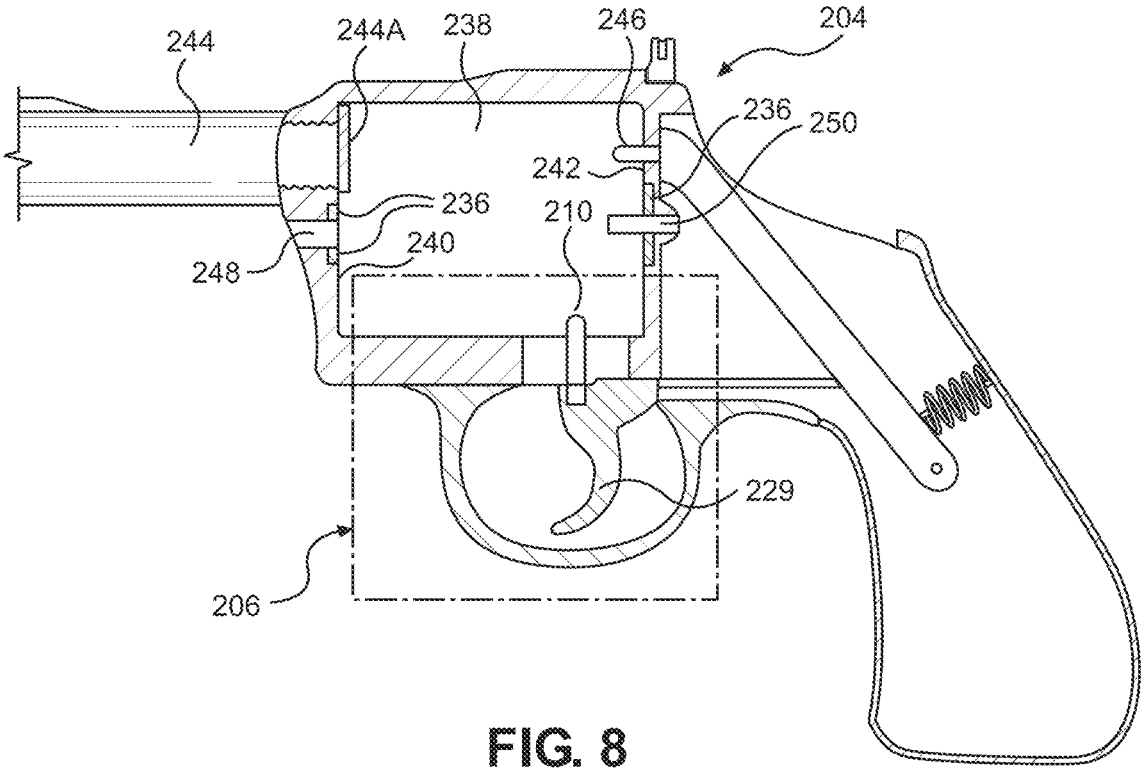
FIG. 8 depicts the frame of FIG. 7 with the trigger in a rearward position and showing the barrel extension.

Next, FIG. 7 and FIG. 8 show the frame 204 without the disposable cylinder system in place, illustrating a trigger system 206 in forward and rearward positions, respectively. As also shown in FIGS. 7 and 8, a barrel extension 244A protrudes into the frame window 238, adjacent to a barrel bore 244. The trigger system 206 operates independently (or in place) of traditional ratchet and pawl mechanisms shown in FIG. 5, thereby providing smoother operation and improved reliability. In particular, in the present design, the traditional ratchet and pawl mechanism is replaced by a spring-biased pin system that includes a pin 210 for selectively engaging a scribed line 212 (FIG. 6) on the cylinder 202, as detailed further below.

Disposable Cylinder

Before detailing the interaction of the cylinder 202 with the spring-biased pin system, a more detailed discussion of the cylinder 202 is provided. Referring to FIGS. 9-12, views of the preloaded disposable cylinder system 202 from a top-down view, cutaway top-down view, muzzle end view, and butt end view are provided, respectively. As shown in these views, the cylinder 202 includes a cylindrical body 214 configured for single-use operation and having a muzzle end 216 and an opposing butt end 218. The cylindrical body 214 includes a plurality of chambers 220 formed radially around a central axis 222. Preferably, each of the chambers 220 is a "blind" chamber that extends partially through the cylindrical body 214, including from an opening located at the muzzle end 216 to a substantially closed butt end 218. The term "substantially closed" is used here to account for the presence of a small opening (i.e., precision-formed primer pocket 220A and flash hole 220C) located at the butt end of the chamber 220. In cylinder 202, each of the plurality of chambers 220 is configured to fire only once, eliminating concerns about metal fatigue, timing wear, and dimensional variations that affect conventional cylinders 108. Advantageously, the single-use design minimizes possible fatigue stress and wear affecting timing wear points while providing better headspace control and more uniform combustion chamber dimensions compared to conventional cartridge-based systems.

Figure 13:
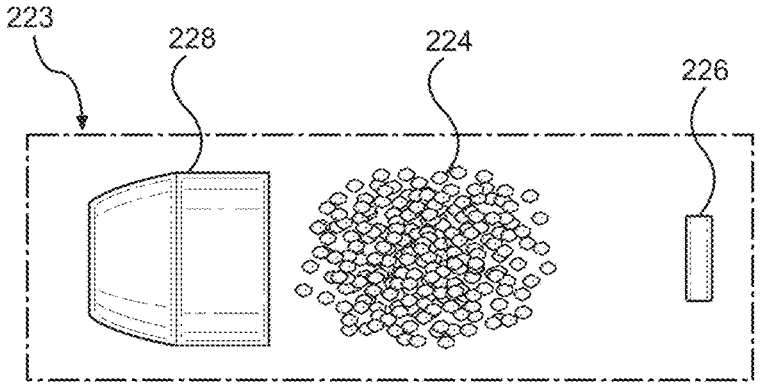
FIG. 13 is an exploded view of a cartridgeless round configured for use in the revolver and cylinder system shown in FIG. 6.

In preferred embodiments, prior to being loaded into a revolver, each chamber 220 is preferably preloaded with a cartridgeless round 223. While the illustrated embodiment depicts a total of six chambers 220, other embodiments may provide fewer chambers or more chambers. As shown in FIG. 13, each cartridgeless round 223 is preferably formed by a propellant 224, primer 226, and projectile components 228 (illustrated as a bullet may be any suitable projectile, e.g., slug, pellets, etc.), but entirely without a separate cartridge case. The design of the cartridgeless round 223 fundamentally distinguishes the present invention from conventional cartridge-based systems, such as that shown in FIG. 3, where traditional cartridges 112 are loaded into chambers 110 of conventional cylinder 108.

The cartridgeless round construction is preferably formed using precise 3D printing of chamber walls that contain the propellant directly within the cylinder structure. The primer 226 is retained within the precision-formed primer pocket 220A integral to the chamber wall, while the projectile 228 is secured by controlled interference fit with the chamber mouth 220B. A small flash hole 220C provides a passageway from the primer pocket 220A into the main body of the chamber 220, allowing the flash of the primer to ignite the propellant 224 contained therein during a firing sequence. The propellant 224 is contained between the primer and projectile without requiring separate cartridge case walls, with combustion pressure contained by the reinforced chamber walls of the 3D printed cylindrical body 214. In particular, the propellant 224 is preferably retained through precision-formed chamber geometry that creates mechanical interference with the projectile base, preventing propellant spillage while allowing controlled release during combustion.

Next, the scribed line 212 is provided (e.g., formed, etched, 3D printed, etc.) in the outer periphery (i.e., the outer exterior peripheral surface) of the cylinder 202 and can be implemented as a zig-zag pattern that provides positive cylinder advancement control. The previously-described spring-biased pin 210 (shown in FIGS. 7 and 8) is connected to the trigger mechanism 206 such that movement of a trigger 229 directly controls rotation of the cylinder 202. In particular, working in conjunction with the zig-zag pattern of the scribed line 212 of cylinder 202, the spring-biased pin 210 is moved forwards and backwards when the trigger 229 is pulled and released. Preferably, when the cylinder 202 is inserted into the frame 204, spring-biased pin 210 automatically registers with and is securely seated within the scribed line 212. Then, as the trigger 229 is pulled and released, the spring-loaded pin 210 remains engaged with and continuously follows the scribed line 212 to induce rotation and indexing of the cylinder 202 within frame 204 of revolver system 200.

Figure 9:
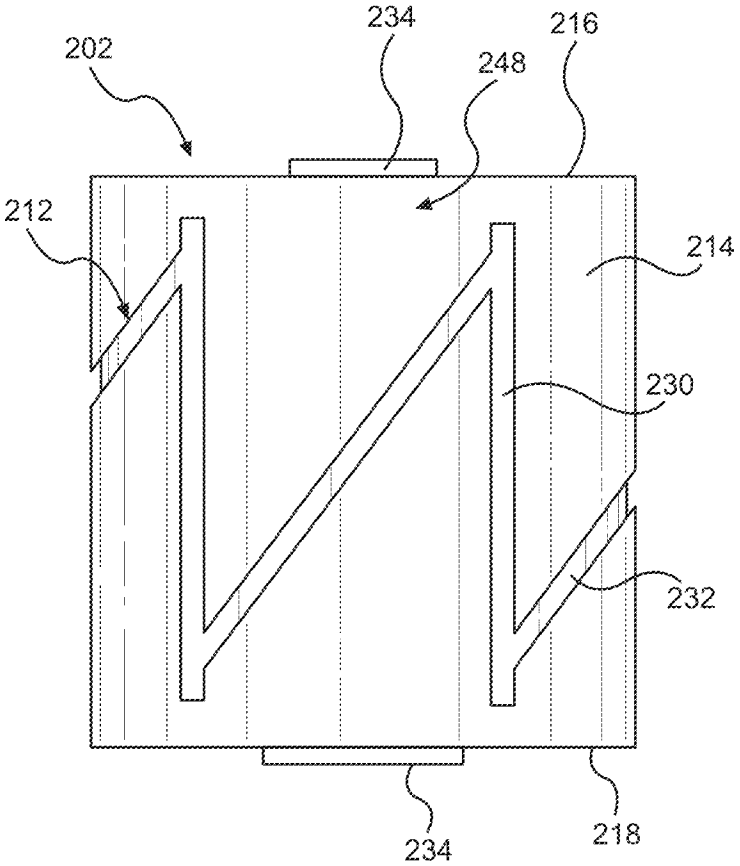
FIG. 9 is a top-down (i.e., plan) view of a preloaded disposable cylinder system according to an embodiment of the present invention showing a cylindrical body with chambers and a scribed line.

The scribed line 212 includes parallel straight portions 230 that each extend partially between the muzzle end 216 and an opposing butt end 218 along the longitudinal extent of the cylindrical body 214. Additionally, parallel slanted portions 232 extend between and connect adjacent pairs of straight portions 230 of the scribed line 212. These slanted portions 232 may intersect at a position along the length of the straight portions 230. However, preferably, the slanted portions 232 intersect the straight portions 230 at a location slightly spaced away from the ends of each straight portion (as depicted in FIG. 9).

In use, rearward travel of the trigger 229 during firing causes pin 210 to travel along one of the straight sections 230 and allows for a smooth trigger pull without unwanted cylinder rotation. After the trigger has been pulled rearwards to an end of the corresponding straight section 230 of the scribed line 212, interaction of the pin 210 with the subsequent slanted portion 232 of the scribed line 212 advances the cylinder 202 to the next chamber position during the trigger's forward return stroke. This movement provides smoother operation and improved reliability compared to traditional ratchet and pawl mechanisms. It also provides positive mechanical control over cylinder indexing while eliminating the complexity and potential failure points of traditional ratchet and pawl systems. Advantageously, engagement of the pin 210 with the scribed line 212 provides self-timing characteristics that ensure proper cylinder alignment with each trigger pull, improving both reliability and accuracy compared to conventional designs.

Mounting and Locking Mechanisms

Figure 12:
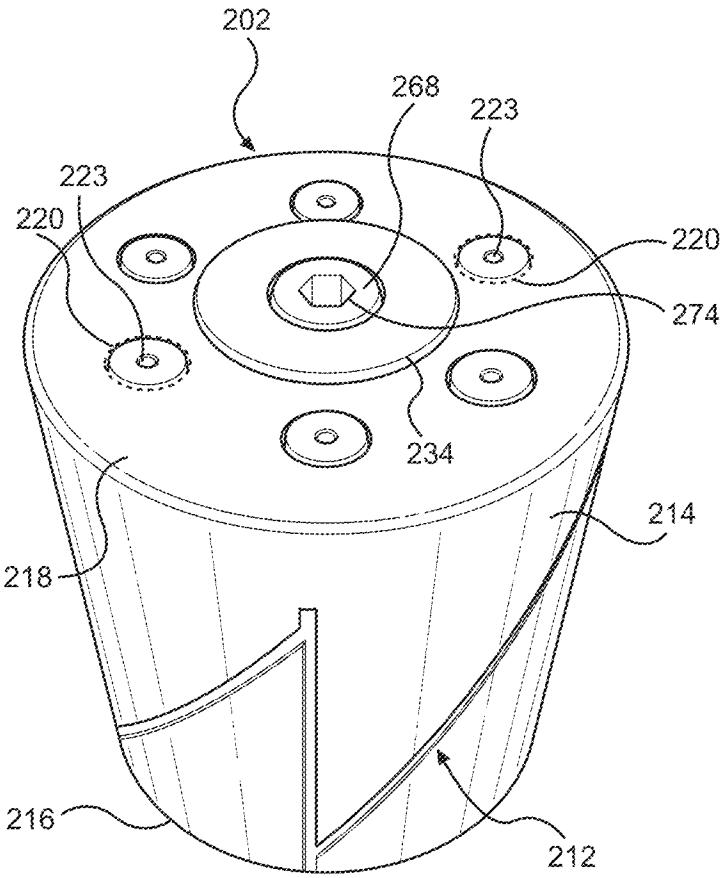
FIG. 12 is a rear perspective view of a butt end of the cylinder system of FIG. 11.
Figure 11:
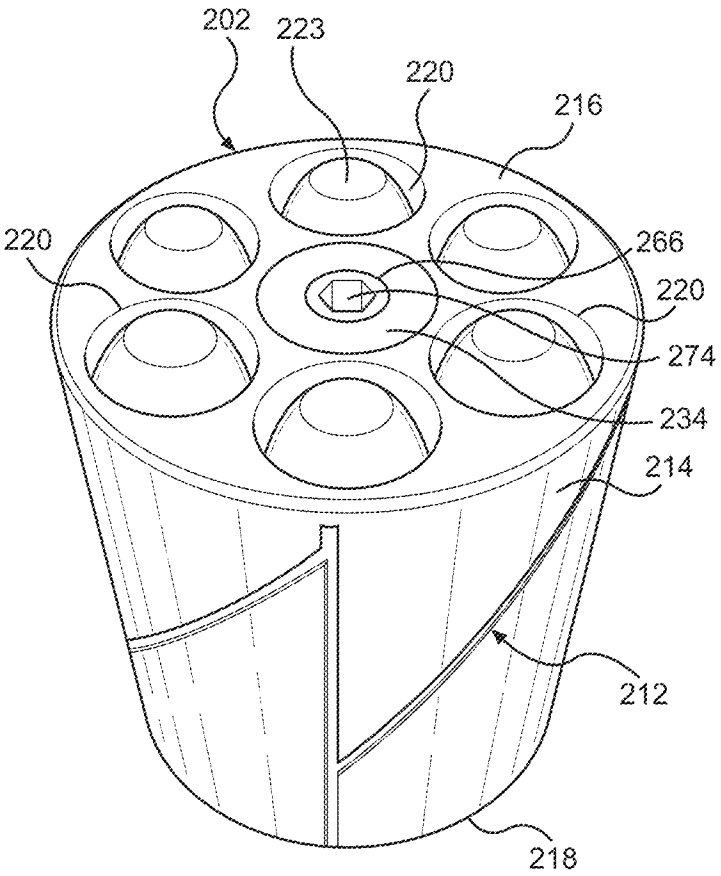
FIG. 11 is a front perspective view of a muzzle end of the cylinder system of FIG. 9 showing a boss pad and cylinder lock pin mounted flush with a boss surface thereof.

Next, as noted previously, FIG. 11 shows a front perspective view of the muzzle end 216 of the cylinder system 202 and FIG. 12 shows a rear perspective view of the butt end 218 of the cylinder system. As illustrated, boss pads 234, which may be interchangeably referred to as a "boss ring" due to their ring-shape design, are centrally located at each of the muzzle end 216 and the butt end 218 of the cylinder 202. In an exemplary embodiment, the boss pad 234 at the butt end has a diameter of approximately 0.593 inches, while the boss pad at the muzzle end has a diameter of approximately 0.468 inches. In this embodiment, both boss pads 234 are raised approximately 0.100 inches from the surface of their respective ends. In preferred embodiments, the boss pad 234 located at the butt end 218 of the cylinder system 202 replaces the conventional ratchet mechanism 116 (FIG. 5). Now, with reference to FIGS. 14-17, boss pads 234 are configured to be received by and guided along recessed cylinder end guideways 236 that are each preferably integrated (i.e., recessed) into the frame 204 of the revolver system 200 to correctly seat and align the cylinder 202 within a frame window 238. Preferably, as illustrated, cylinder end guideways 236 are tapered in one but preferably two dimensions, which may include height H and/or depth D.

Figure 14:
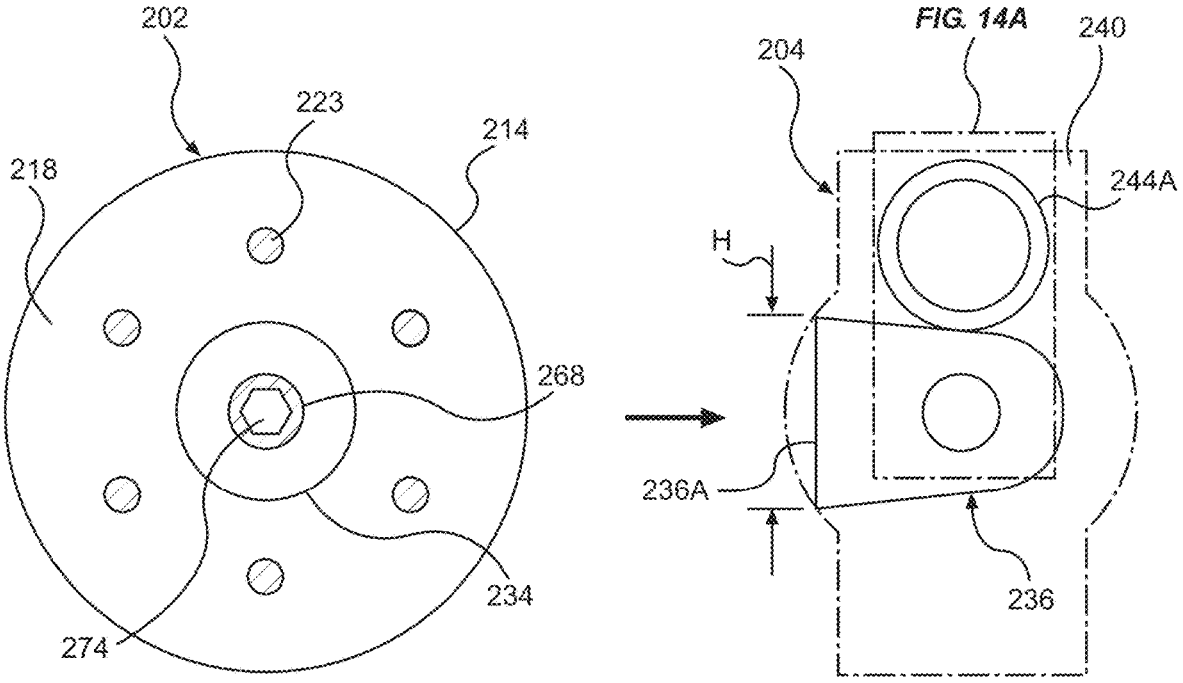
FIG. 14 is a forward-facing elevation view of the cylinder system of FIG. 6, fully loaded with ammunition, being inserted into the revolver.
Figure 15:
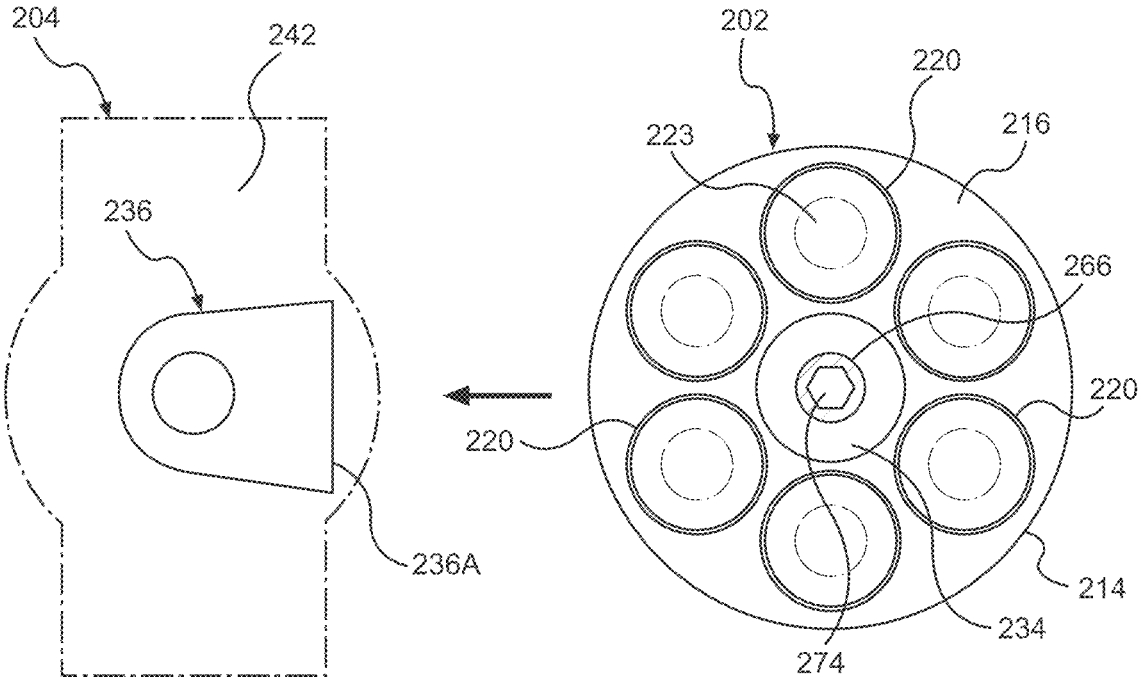
FIG. 15 is a rearward-facing elevation view of the cylinder system of FIG. 14 being inserted into the revolver.

Advantageously, tapering the cylinder end guideways 236 in this manner provides automatic rough-to-fine guidance for automatically aligning and then automatically seating the boss pads 234 when the cylinder 202 is inserted into the frame window 238. More particularly, initial rough guidance is provided by generally rectangular shape of the frame window 238 itself for the rounded profile of the cylindrical body 214. Next, additional guidance is provided by cylinder end guideways 236 in the vertical (i.e., up and down) direction by widening the height H of the first portion 236A of the cylinder end guideways, as shown in FIGS. 14 and 15. Additionally, in preferred embodiments, the boss pad 234 located at one end of the cylinder 202, and its corresponding cylinder end guideway 236, may be larger or smaller than the boss pad and cylinder end guideway located at the opposing end of the cylinder. This is a safety and convenience feature that assists the user in quickly orienting the cylinder in the correct butt-to-muzzle direction and to prevent the cylinder from being accidentally installed in a reversed direction by providing the butt end boss pad with a larger diameter than the muzzle end boss pad.

Figure 14A:
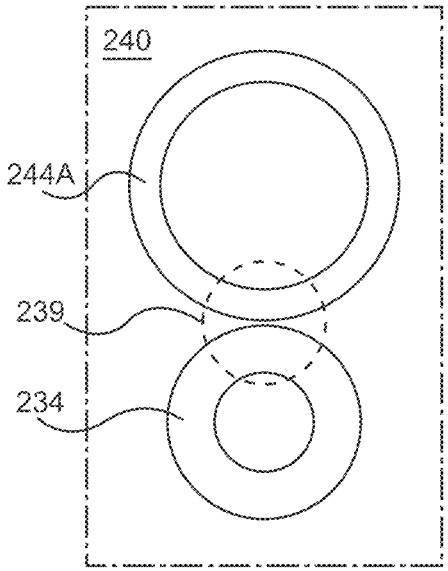
FIG. 14A is an enlarged detail view taken from FIG. 14, showing tangential contact between a muzzle end boss pad and a barrel extension.

In a further novel aspect of the alignment system, best shown in FIG. 14A, the diameter of the muzzle end boss pad 234 is specifically controlled (e.g., to approximately 0.468 inches) to create a tangential contact point 239 with a barrel extension 244A that protrudes into the frame window 238 (see also FIGS. 7 and 8). This tangential, surface-to-surface contact between the outer radial surface of the smaller-diameter boss pad 234 and the outer radial surface of the larger-diameter barrel extension 244A provides an additional, passive, and automatic vertical alignment feature as the cylinder 202 is inserted. This interaction ensures precise alignment with the barrel bore 244, further enhancing the speed and reliability of reloading.

It is also preferable to position the cylinder 202 with fine alignment for "end shake" and "gas gap" control. Preferably, the cylinder 202 is sized and arranged such that clearance space between it and a muzzle end 240 and butt end 242 of the frame window 238 is as near to zero as is possible. This close fit is, however, in conflict with providing for wider tolerance for rapid insertion of the cylinder into the frame window 238 of the frame 204 due to the potential for "jamming" during the insertion step. One solution is to provide a wider opening in the dimension (i.e., depth D) between the front and rear mating surface of the frame 204 at the first portion 236A of the cylinder end guidance 236, but then narrowing that spacing as the cylinder is pushed into the frame window 238 into its final locked position. This arrangement, therefore, provides a "funneling" effect that satisfies both requirements of fine alignment without unwanted jamming. Accordingly, as discussed above, as a result of tapering in both the height H and depth D, the present design provides two-dimensional alignment of the cylinder 202 with the frame 204 and frame window 238.

Additionally, the engagement of boss pads 234 with cylinder end guideways 236 provides precise positioning of the cylinder 202 relative to the frame 204 and ensure proper alignment with the barrel extension 244A, barrel bore 244 and firing pin 246 (see FIGS. 7 and 8). Accordingly, the present design advantageously eliminates (or at least reduces) the precision requirements of conventional crane-based systems.

Figure 17:
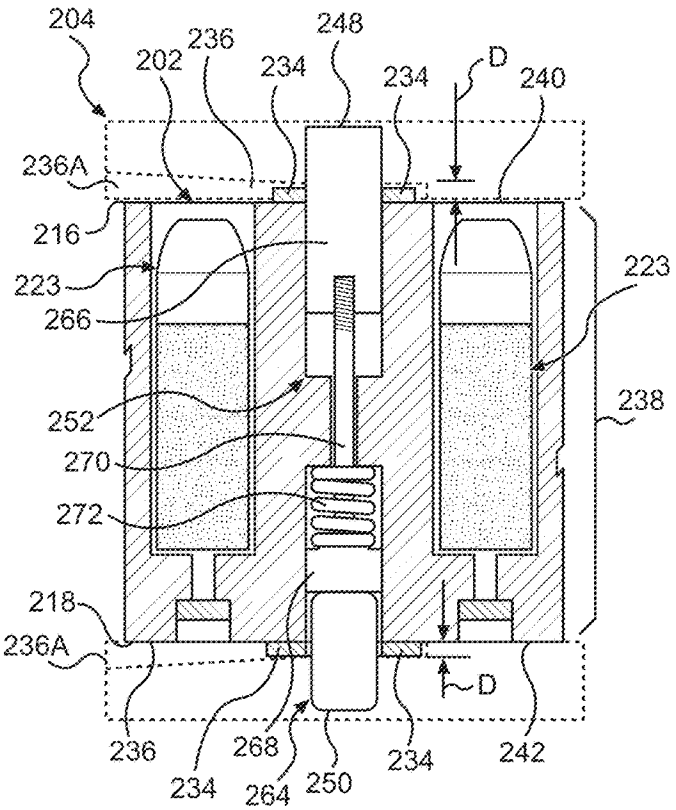
FIG. 17 is a top-down view showing the cylinder system of FIG. 16 after being inserted into the revolver.
Figure 16:
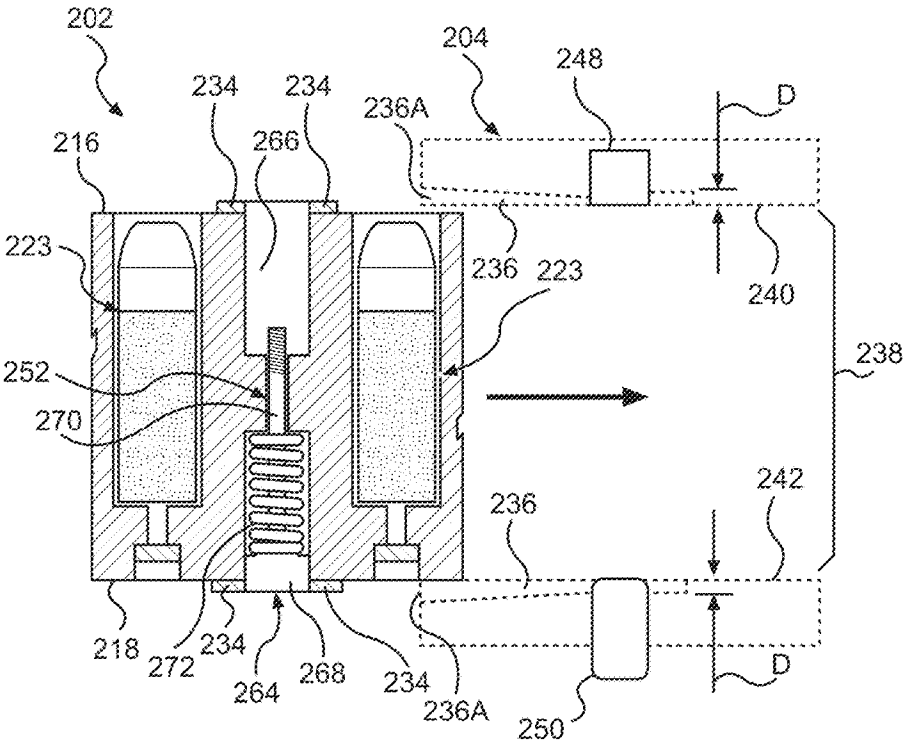
FIG. 16 is a top-down view showing the cylinder system of FIG. 6 being inserted into revolver.
Figure 18:
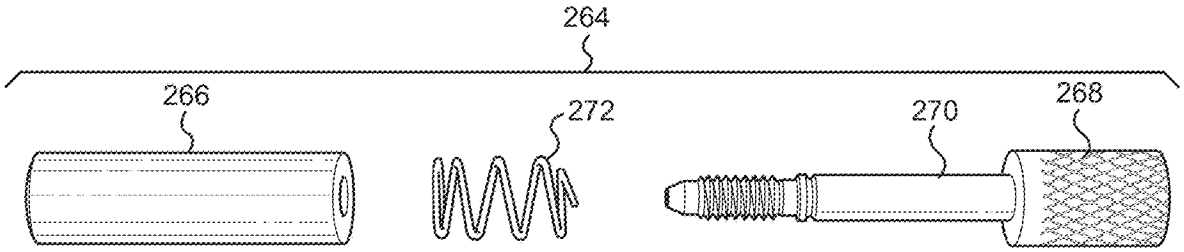
FIG. 18 is an exploded view of a spring-loaded center pin mechanism according to an embodiment of the present invention.

Now, with reference to FIGS. 16 and 17, the frame window 238 includes a muzzle end 240 and opposing butt end 242, and the space between those opposing ends is sized to allow the cylinder 202 to be easily inserted while providing a close fit. The muzzle end 240 of the frame window 238 includes a centrally-disposed front latch recess 248. Frame 204 also includes a cylinder lock up pin 250 that extends from the butt end 242 of the frame window 238. The cylinder lock up pin 250 is preferably biased to a locked position where it automatically extends into the frame window 238, and it is retracted to an unlocked position via a cylinder release latch (not shown). The purposes and operation of the above described latch recess 248 and cylinder lock up pin 250 will be described in greater detail below. As will be shown below, cylinder retention is achieved through mechanical engagement features that lock the cylinder 202 in position without requiring complex latching mechanisms, providing both axial and rotational constraint while allowing for rapid cylinder removal and replacement.

Figure 10:
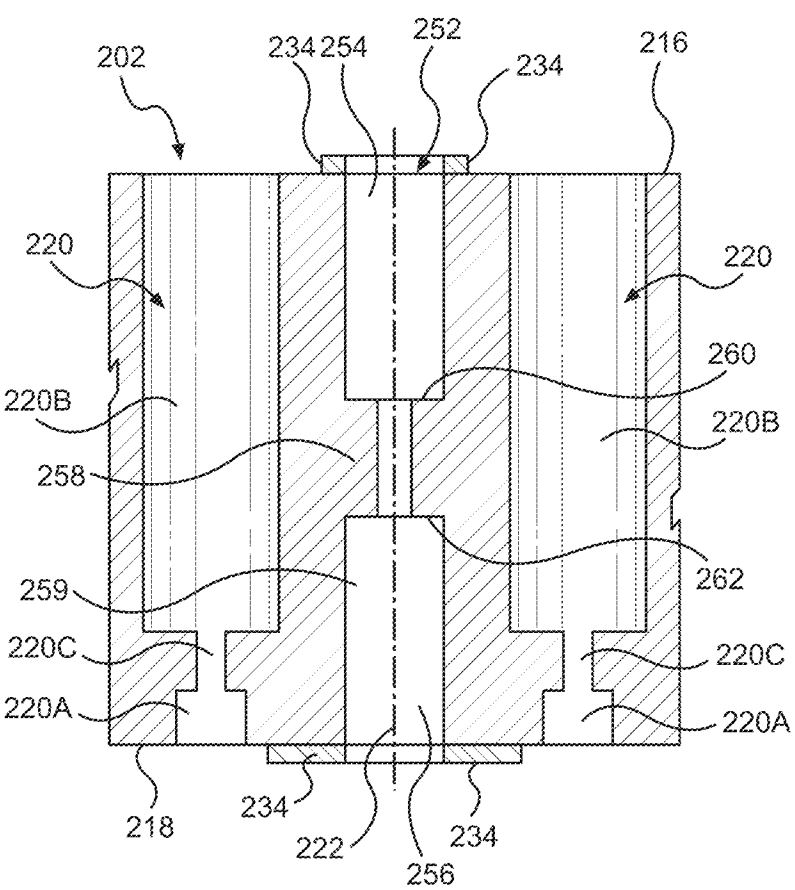
FIG. 10 is a cross-sectional view of the preloaded disposable cylinder system of FIG. 9.

Next, with reference to FIG. 10, cylinder 202 is provided with a center pin channel 252 that extends along an entirety of the cylinder and is colinear with central axis 222, including from the muzzle end 216 to the butt end 218 and including through the boss pads 234 located at each end of the cylinder. The center pin channel 252 includes a muzzle end portion 254 that terminates at an opening formed at the muzzle end 216 of the cylinder 202, a butt end portion 256 that terminates at an opening formed at the butt end 218 of the cylinder, and a center portion 258, where the muzzle end portion 254 and the butt end portion 256 connect together to form a single continuous channel. Preferably, the center portion 258 has a smaller cross-sectional area than both the muzzle end portion 254 and the butt end portion 256. The difference in cross-sectional areas provides an annular muzzle end shoulder 260 at an interface of the muzzle end portion 254 and the center portion 258 and also an annular opposing butt end shoulder 262 at an interface of the butt end portion 256 and the center portion. Each of the annular muzzle end shoulder 260 and annular opposing butt end shoulder 262 are ring or annular-shaped. The muzzle end shoulder 260 and the butt end shoulder 262 each provide a bearing surface within the center pin channel 252 for components of a spring-loaded center pin mechanism, which will be discussed below.

Now, with reference to FIGS. 10 and 16-18, cylinder system 202 is inserted into the frame window 238 between two cylinder end guideways 236 of the frame 204. Also shown in these views is a spring-loaded center pin mechanism 264 disposed in the centrally located channel 252, which may be used to securely and removably lock the cylinder 202 in the frame window 238 while still allowing the cylinder to rotate during a firing sequence. As shown, the center pin mechanism 264 includes a locking pin 266 that is sized and configured to be located within the muzzle end portion 254, a butt end pin member 268 sized and configured to be located within the butt end portion 256, a connecting rod 270 extending through the center portion 258 and connecting the locking pin and butt end pin member together, and a spring 272 disposed in the butt end portion and biasing the locking pin to the unlocked position shown in FIG. 17. In preferred embodiment, each major section of the spring-loaded center pin mechanism 264, including the locking pin 266, butt end pin member 268, and spring 272, has an outer diameter of 0.250" (nominal dimension). However, in other embodiments, the size of these components may be larger or smaller to accommodate larger or smaller size needs.

As shown in FIG. 16, in the unlocked position, the locking pin 266 is in a retracted position that permits the cylinder 202 to easily slide into the frame window 238 and to be loaded into the frame 204. Next, as shown in FIG. 17, after the cylinder 202 is fully inserted into the frame window 238 and the cylinder release latch (not shown) is disengaged, the cylinder lock up pin 250 automatically extends into the opening of the butt end portion 256 of channel 252. The cylinder lock up pin 250 then pushes against the butt end pin member 268 of the center pin mechanism 264. The cylinder lock up pin 250 is biased with a force configured to be greater than the opposing biasing force of spring 272, thereby causing the spring to compress as the entire center pin mechanism 264 is pushed forward. This forward motion pushes the connecting rod 270 towards the muzzle end portion 254, which in turn also pushes the locking pin 266 into a locked position where a portion of the locking pin extends out of the muzzle end portion 254 and at least partially into the front latch recess 248, thereby rotatably locking the frame 204 and the cylinder 202 together at both ends of the frame window 238.

Next, when cylinder lock up pin 250 pushes against the butt end pin member 268, it also at least partially compresses the spring 272 located in the butt end portion 256. The cylinder 202 may be removed from the frame window 238 by first engaging the cylinder release latch to retract the cylinder lock up pin 250, which causes the now-compressed spring 272 to automatically expand and to push against butt end shoulder 262 (FIG. 10), which causes the entire spring-loaded center pin mechanism 264 to move towards the butt of the revolver and automatically retracts the locking pin 266 from the latch recess 248. This, in turn, permits the cylinder 202 to be easily removed from the frame window 238.

In certain embodiments, spring-loaded center pin mechanism 264 is formed by one or more threaded connections. For example, in the illustrated embodiment, one end of the connecting rod 270 is threaded and is received in a corresponding threaded opening formed in the locking pin 266. The locking pin 266 and connecting rod 270 may be formed as a single component or the butt end pin member 268 and the connecting rod may be formed as a single component, thereby not requiring a threaded connection. However, in other embodiments, the opposite end or both ends of the connecting rod 270 may be threaded. Preferably, as shown in FIGS. 14 and 15, exposed ends of the locking pin and the butt end pin member include engagement components 274 for facilitating rotation to connect and disconnect the threaded connections, such as with a screwdriver or hex key, thereby enabling field assembly and disassembly of the center pin mechanism 264.

Reloading Sequences

Figure 19:
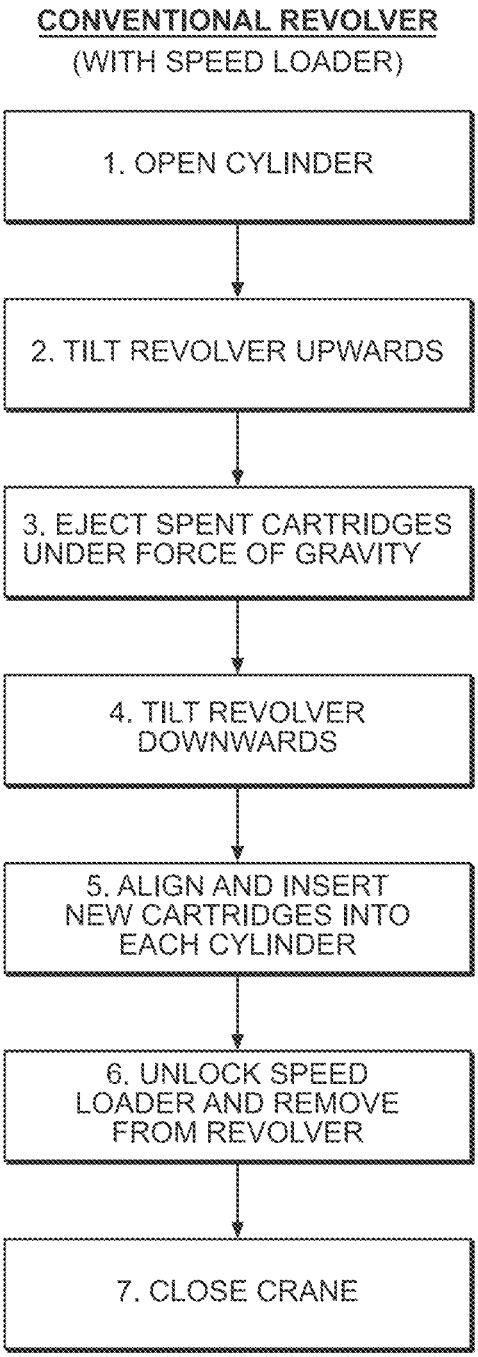
FIG. 19 is a flowchart showing the reloading sequence for a conventional revolver with speed loader.
Figure 20:
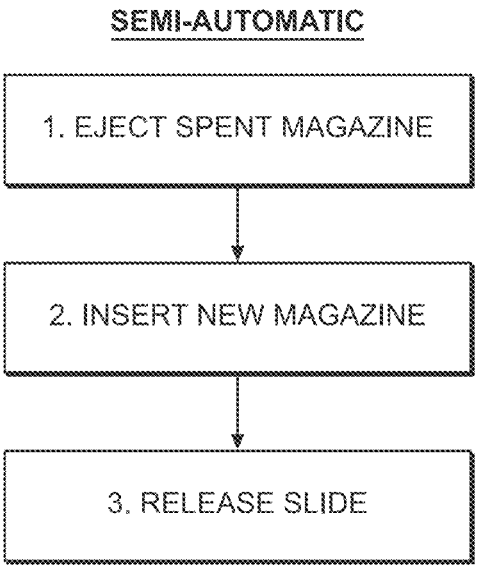
FIG. 20 is a flowchart showing the reloading sequence for a semi-automatic pistol.
Figure 21:
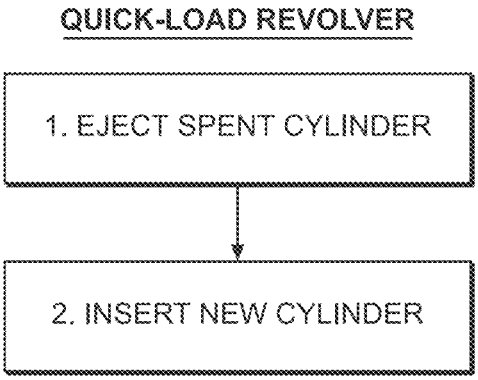
FIG. 21 is a flowchart showing the reloading sequence for the quick-load revolver according to the present invention.

Finally, flowcharts describing reloading sequences for different handgun types are provided in FIGS. 19-21. In particular, FIG. 19 shows the reloading sequence for a conventional revolver with a speed loader, requiring seven distinct steps: (1) open the cylinder via crane mechanism; (2) tilt the revolver upwards; (3) eject spent cartridges using an extractor system; (4) tilt the revolver downwards; (5) align and insert new cartridges; (6) unlock and release the speed loader; and (7) close the crane mechanism. FIG. 20 illustrates the reloading sequence for a semi-automatic pistol, typically requiring three steps: (1) eject spent magazine; (2) insert new magazine; and (3) release slide. Finally, FIG. 21 shows the reloading sequence for the quick-load revolver according to the present invention, requiring only two steps: (1) eject the spent cylinder and (2) insert a new, fresh cylinder. This two-step reloading process enables much faster reloading times for revolvers, significantly outperforming reload speeds for conventional revolvers and even approaching semi-automatic pistol reload speeds.

Design Variations

It is noted that at least two variations are possible for the frame and disposable cylinder system herein described. First, a cylinder according the present invention may be formed with minimum modification and through the elimination of parts to provide a cartridge-compatible design of a cylinder formed using either a 3D printed design or a machined cylinder design. Next, in preferred embodiments, including those shown in the appended figures, a cartridgeless blind chamber preloaded design that is 3D compatible may be loaded into a "full frame" (i.e., a frame without cutouts for a crane mechanism). As above, the cartridgeless blind chamber design can also be made in either a traditional machined metal configuration or a 3D design. In either case, the preloaded cylinder design can incorporate the scribed line or the pawl and ratchet designs discussed above.

Material Specifications

Next, the disposable cylinder may be manufactured from various 3D printing compatible materials including but not limited to, high-performance polymers such as Polyether ether ketone (PEEK) and Polyetherketoneketone (PEKK), reinforced polymer compositions such as carbon fiber-filled or glass-filled Nylons, or specialized composite materials designed for single-use firearm applications. The 3D printing materials are selected to withstand pressures of standard handgun cartridge pressures, for example, in the range of 17,000 to 25,000 PSI, with safety margins incorporated for single-use applications. Materials are preferably selected to withstand such pressures with a safety factor exceeding 2:1. The single-use design eliminates the need for materials capable of withstanding repeated firing cycles, enabling the use of lighter, less expensive materials while maintaining safety and performance. The lower weight design provides additional handling advantages while the one-time use nature is compatible with lighter cylinder materials. Frame materials may include traditional steel alloys with reinforcement features designed to handle the stresses associated with the improved lock-up system. Materials used may also include alloys of titanium and stainless steel. While not required, in certain embodiment of the invention, it may be desired to incorporate additional material in critical stress areas of the frame to ensure long-term durability while accommodating the direct cylinder insertion design without traditional crane mechanisms. It is noted that the above discussion of materials is merely exemplary and a person of skill in the art would understand that other suitable materials may also be used.

Compatibility Features

The system is designed to be compatible with both single action and double action revolver mechanisms, as well as existing Colt® and Smith & Wesson® revolver designs, including clones thereof and even entirely different revolvers, through minor frame modifications. The disposable cylinder system does not interfere with the basic firing mechanism, whether single action (requiring manual hammer cocking) or double action (trigger-actuated hammer cocking), because the cylinder retention and rotation systems operate independently of the hammer and firing pin mechanisms. The compatibility extends to nearly all copies and clones of Smith & Wesson® designs including but not limited to Ruger®, Charter Arms®, and Taurus® revolvers, requiring only modification of the frame window and installation of the cylinder end guideways.

Existing revolver frames can optionally be modified to accommodate the disposable cylinder system by machining appropriate guide channels, installing the spring-biased pin mechanism, and reinforcing critical stress areas, as needed. As noted above, frame modifications eliminate the need for traditional crane cutouts, thereby strengthening the overall frame structure while providing superior cylinder lock-up. The design eliminates or simplifies problematic parts to manufacture including crane, cylinder ratchet, extractor, hand, and bolt (or cylinder stop).

Safety Features

The cartridgeless round design incorporates multiple safety mechanisms including: (1) drop-safe construction where primers are recessed below the cylinder surface to prevent accidental ignition; (2) controlled pressure containment through engineered wall thickness of the 3D printed chambers designed to handle expected pressure loads; (3) predictable failure modes under excessive pressure conditions that direct gases away from the user; and (4) secure propellant retention systems that prevent spillage during handling and transport. In certain embodiments, the 3D printed chamber walls are designed with safety factors exceeding 2:1 for expected pressure loads, with controlled failure points that direct excessive pressure away from the user.

As noted above, the system is designed to be compatible with existing Colt® and Smith & Wesson® revolver designs, including clones thereof and even entirely different revolvers, through minor frame modifications. Preferably, in construction and operation, embodiments of the present invention compatible with Colt® and Smith & Wesson® (and other) cylinder lock up mechanisms are essentially the same as those original designs. The primary difference is the roleplaying function of the male and female parts located at the butt and muzzle ends of the cylinder. For example, the spring loaded male member of the Smith & Wesson® design is located in the forward section of the frame. On the other hand, in the Colt® design, the female part is located in the forward section of the frame. Those of skill in the art will understand and appreciate these and similar structural and functional differences that would be needed to tailor the present invention for various revolver models.

The cylinder latch mechanism and safety features of the original Colt® and Smith & Wesson® designs are preferably maintained in embodiments of the present invention. For example, one safety feature found in both conventional designs that will be repeated in the present design is that the firing mechanism is prevented from firing unless the lock up system is fully seated and locked in place.

Advantages of the Invention

The preloaded disposable cylinder system provides significant advantages over conventional revolver designs. The following is a list of some, but certainly not all, of the advantages of the present design. Those of skill in the art will appreciate these and other advantages of the present design.

Reloading Speed: The two-step reloading process (snap out/snap in) provides faster reloading compared to current revolver design and approaches semi-automatic pistol reload speeds.

Superior Lock-up Strength: The dual-end cylinder retention system provides a stronger lock-up compared to conventional designs, with both cylinder ends secured directly into the frame structure, eliminating structural weaknesses inherent in crane-based systems.

Enhanced Accuracy: Improved cylinder alignment through precision guideways and consistent chamber dimensions from 3D printing contribute to superior accuracy. The elimination of cartridge case dimensional variations provides better headspace control and combustion chamber uniformity.

Manufacturing Efficiency: Elimination of extractors, cranes, ratchets, and pawls significantly reduces manufacturing complexity and costs. 3D printing compatibility further reduces production costs while enabling rapid prototyping and customization.

Improved Reliability: The simplified mechanical system with fewer moving parts reduces potential failure points. Single-use cylinders eliminate timing wear, metal fatigue, and dimensional variations affecting conventional cylinders.

Maintenance Advantages: Single-use cylinders eliminate cleaning requirements and residue build-up that can affect timing and operation, particularly beneficial for applications where frequent cleaning is impractical.

Flexibility: Another advantage of the present design is its flexibility. Several variations are available while still taking advantage of elimination of the crane and extractor. For example, both cartridge-based and cartridgeless designs are possible, as well as designs with variations of ratchet and hand (i.e., pawl), zig-zag designs for rotation, or variations of 3D printing, or conventional machines cylinder design. However, it is noted that, if the cartridge style is desired, another method of cartridge extraction must be provided. In the discussion above, the term "hand" is used to refer to the component that interacts with the ratchet to accomplish rotation of the cylinder. While the term "hand" is preferred and is more technically correct, it may also be used interchangeably with the word "pawl."

What is claimed is:

1. A disposable cylinder for use in a revolver, comprising:

a cylindrical body configured for single-use operation and having a muzzle end and an opposing butt end;

a muzzle end boss pad located at the muzzle end and a butt end boss pad located at the butt end of said cylinder, wherein the butt end boss pad has a first diameter and the muzzle end boss pad has a second diameter, the first diameter being different than the second diameter to prevent backward installation of the cylinder; and a plurality of chambers formed radially around a central axis and extending from an opening at the muzzle end to a substantially closed butt end, each chamber preloaded with propellant, primer, and projectile components but entirely without separate cartridge cases, each of the plurality of chambers configured to fire only once.

2. The disposable cylinder of claim 1, wherein the cylindrical body is 3D printed.

3. The disposable cylinder of claim 1, wherein said cylindrical body is manufactured from materials selected from the group consisting of reinforced nylon, glass-filled polymer, and composite materials compatible with 3D printing and firearm pressure requirements.

4. The disposable cylinder of claim 1, wherein the boss pads are configured to be received by cylinder end guideways of a revolver frame to correctly seat and align the cylinder within a frame window whereby the muzzle end boss pad is received by the muzzle end guideway and the butt end boss pad is received by the butt end guideway.

5. The disposable cylinder of claim 1, wherein the muzzle end boss pad is configured to create a tangential contact point with a barrel extension of a revolver frame to provide vertical alignment upon insertion.

6. The disposable cylinder of claim 1, further comprising a scribed line formed in an outer periphery of said cylindrical body for controlling cylinder rotation.

7. The disposable cylinder of claim 6, wherein the scribed line includes parallel straight portions extending partially along a longitudinal extent of the cylinder and slanted portions connecting adjacent pairs of straight portions.

8. The disposable cylinder of claim 1, further comprising a center pin channel extending longitudinally through a center of said cylinder from the muzzle end to the butt end.

9. The disposable cylinder of claim 8, wherein the channel includes a muzzle end portion, a butt end portion, and a center portion having a smaller cross-sectional area than the muzzle end portion and the butt end portion to provide annular shoulders at interfaces between the portions.

10. The disposable cylinder of claim 9, further comprising a spring-loaded center pin mechanism disposed within the center pin channel and configured to secure the cylinder within a revolver frame.

11. A revolver system comprising:

(a) a disposable cylinder according to claim 4;

(b) a frame having:

(i) a frame window configured to directly receive the disposable cylinder, said frame lacking a cutout for a crane mechanism;

(ii) cylinder end guideways configured to receive the boss pads to align the cylinder; and (c) a trigger system.

12. The revolver system of claim 11, wherein the cylinder end guideways are tapered in height and depth to guide the boss pads into correct seating and alignment within the frame window.

13. The revolver system of claim 11, further comprising a spring-biased pin operatively connected to the trigger system and configured to engage a scribed line on the disposable cylinder to control rotation thereof.

14. The revolver system of claim 11, wherein the cylinder further comprises a spring-loaded center pin mechanism and the frame further comprises a cylinder lock up pin configured to actuate the center pin mechanism, thereby locking the cylinder within the frame window at both its muzzle and butt ends.

15. The revolver system of claim 14, wherein the spring-loaded center pin mechanism is configured to automatically retract a locking portion thereof from the frame when the cylinder lock up pin is disengaged.

16. A method of reloading a revolver comprising:

(a) providing said revolver, the revolver having a frame with a frame window, lacking a crane mechanism, and provided with a first disposable cylinder comprising:

a cylindrical body configured for single-use operation and having a muzzle end and an opposing butt end;

a muzzle end boss pad located at the muzzle end and a butt end boss pad located at the butt end of said cylinder, wherein the butt end boss pad has a first diameter and the muzzle end boss pad has a second diameter, the first diameter being different than the second diameter to prevent backward installation of the cylinder; and a plurality of chambers formed radially around a central axis and extending from an opening at the muzzle end to a substantially closed butt end, each chamber preloaded with propellant, primer, and projectile components but entirely without separate cartridge cases, each of the plurality of chambers configured to fire only once;

(b) ejecting the first disposable cylinder from the frame window; and (c) inserting a second disposable cylinder directly into the frame window, wherein the second disposable cylinder is locked into the frame at a muzzle end and a butt end without manipulation of a crane.

17. The method of claim 16, wherein the method eliminates the step of extracting spent cartridge cases from a cylinder.

18. The method of claim 16, wherein the inserting step includes aligning the cylinder using tapered guideways integrated into the frame.

* * * * *